US009499304B2

(12) United States Patent
Leisch

(10) Patent No.: US 9,499,304 B2
(45) Date of Patent: Nov. 22, 2016

(54) UNDERLAY DEVICE FOR TRANSPORTATION AND PRESENTATION CONTAINERS

(75) Inventor: Franz Leisch, Linz (AT)

(73) Assignee: Leisch Beratungs- und Beteiligungs-GmbH, Linz (AT)

( * ) Notice: Subject to any disclaimer, the term of this patent is extended or adjusted under 35 U.S.C. 154(b) by 669 days.

(21) Appl. No.: 13/516,816

(22) PCT Filed: Dec. 15, 2010

(86) PCT No.: PCT/AT2010/000481

§ 371 (c)(1),
(2), (4) Date: Aug. 27, 2012

(87) PCT Pub. No.: WO2011/072317

PCT Pub. Date: Jun. 23, 2011

(65) Prior Publication Data

US 2013/0004636 A1 Jan. 3, 2013

(30) Foreign Application Priority Data

Dec. 17, 2009 (AT) ..... GM806/2009
Jan. 12, 2010 (AT) ..... GM13/2010
Feb. 3, 2010 (AT) ..... GM66/2010

(51) Int. Cl.
*B65D 25/24* (2006.01)
*A47F 3/14* (2006.01)
(Continued)

(52) U.S. Cl.
CPC ..... *B65D 25/24* (2013.01); *A47F 3/14* (2013.01); *A47F 5/12* (2013.01); *B65D 85/34* (2013.01);
(Continued)

(58) Field of Classification Search
CPC ..... B65D 25/24; B65D 85/34; B65D 21/0209; B65D 21/0217; B65D
(Continued)

(56) References Cited

U.S. PATENT DOCUMENTS 4,550,837 A * 11/1985 Simmons ..... 211/128.1
7,320,409 B2 * 1/2008 Stagnetto ..... 220/4.27
(Continued)

FOREIGN PATENT DOCUMENTS

DE 342 62 14 A1 1/1986
DE 94 15 866 U1 4/1995
(Continued)

OTHER PUBLICATIONS

International Search Report of PCT/AT2010/000481, date of mailing Mar. 15, 2011.
(Continued)

*Primary Examiner* — Fenn Mathew
*Assistant Examiner* — Elizabeth Volz
(74) *Attorney, Agent, or Firm* — Collard & Roe, P.C.

(57) ABSTRACT

The invention relates to an underlay device (1) for a transportation and presentation container (12) for food, such as fruits and/or vegetables, wherein the transportation and presentation container (12) comprises a bottom part (13) and four side wall parts (14, 14', 14", 14'''), and the underlay device (1) has four sides walls (3, 3', 3", 3''') arranged in a frame shape as an underlay frame (2) of the transportation and presentation container (12) and/or at least three side walls (17, 17', 17") having dimensions as an underlay apparatus (16) so that the bottom part (13) of the transportation container (12) can be placed on the underlay frame (2) or the underlay apparatus (16).

14 Claims, 5 Drawing Sheets

(51) Int. Cl.

| | |
|---|---|
| ***A47F 5/12*** | (2006.01) |
| ***B65D 85/34*** | (2006.01) |
| *B65D 21/02* | (2006.01) |
| *A47F 7/00* | (2006.01) |

(52) U.S. Cl.
CPC ..... *A47F 7/0071* (2013.01); *B65D 21/022* (2013.01); *B65D 21/023* (2013.01); *B65D 21/0209* (2013.01); *B65D 21/0217* (2013.01); *B65D 21/0219* (2013.01); *B65D 21/0222* (2013.01)

(58) Field of Classification Search
CPC ..... 21/0219;B65D 21/002; B65D 21/023; A47F 3/14; A47F 5/12; A47F 7/0071; A61J 1/16
USPC ..... 220/4.27, 729, 737; 206/45.2, 45.24; 312/114, 118
See application file for complete search history.

(56) References Cited

U.S. PATENT DOCUMENTS

| | | | |
|---|---|---|---|
| 2002/0004997 | A1 | 1/2002 | Pizzamiglio et al. |
| 2005/0011845 | A1 | 1/2005 | Ernst et al. |
| 2006/0138130 | A1 | 6/2006 | Orgeldinger |
| 2007/0023319 | A1 | 2/2007 | Honkawa et al. |
| 2008/0110880 | A1 | 5/2008 | Orgeldinger |
| 2009/0236337 | A1 | 9/2009 | Orgeldinger |
| 2011/0094916 | A1 | 4/2011 | Orgeldinger |

FOREIGN PATENT DOCUMENTS

| | | | | |
|---|---|---|---|---|
| DE | 198 09 498 | | 9/1999 | |
| DE | 19809498 | * | 9/1999 | ..... A47F 5/10 |
| DE | 203 19 141 | U1 | 2/2004 | |
| EP | 1 493 363 | A1 | 1/2005 | |
| EP | 1 921 014 | | 5/2008 | |
| FR | 857 001 | | 8/1940 | |
| FR | 857001 | * | 8/1940 | ..... B65D 25/04 |
| FR | 2 072 314 | | 9/1971 | |
| FR | 2072314 | * | 9/1971 | ..... B65D 1/34 |
| GB | 1 337 569 | | 11/1973 | |
| GB | 2 292 934 | A | 3/1996 | |
| JP | S57-17771 | A | 1/1982 | |
| JP | S62-144848 | U | 9/1987 | |
| WO | WO 2004/110884 | | 12/2004 | |
| WO | 2005/055775 | A1 | 6/2005 | |

OTHER PUBLICATIONS

International Preliminary Report on Patentability, Jul. 4, 2012, with Written Opinion of the International Searching Authority.

* cited by examiner

UNDERLAY DEVICE FOR TRANSPORTATION AND PRESENTATION CONTAINERS

CROSS REFERENCE TO RELATED APPLICATIONS

This application is the National Stage of PCT/AT2010/000481filed on Dec. 15, 2010 which claims priority under 35 U.S.C. §119 of Austrian Application No. GM 806/2009 filed on Dec. 17, 2009, Austrian Application No. GM 13/2010 filed on Jan. 12, 2010, and Austrian Application No. GM 66/2010 filed on Feb. 3, 2010, the disclosures of which are incorporated by reference. The international application under PCT article 21(2) was not published in English.

The present invention describes an underlay device for a transportation and presentation container for food, such as e.g. fruit and/or vegetables, wherein the transportation and presentation container comprises a bottom part and four side wall parts, as well as a transportation and presentation container system comprising a collapsible or non-collapsible transport container with a bottom part and four side wall parts and the use thereof.

Known non-collapsible and collapsible containers for food products, such as fruit and vegetables, in particular for transportation and presentation on the shelves of retail chains are often made of plastic, wood or cardboard. With collapsible transport containers mostly the side walls can be moved towards the inner base surface of the transport container, whereby the volume of the transportation container when empty is reduced. Furthermore, the bottom part on the side opposite the base surface has a profile or a device, by means of which the transport containers can be stacked. As the size of different food products such as fruit and vegetables varies accordingly to the harvest, the size of the transport container also varies. The size of transport containers, for fruit and vegetables for example, is also defined by the variety of products, their size and filling contents. In order to achieve the optimal filling of the transport containers—transport containers of different sizes are used.

The supplier of fruit and vegetables packs the products into said transport containers and delivers them in this way to the distribution center. The containers are then commissioned in the distribution center and delivered to the stores.

In the stores the containers are then placed onto the shelves provided for fruit and vegetables (shelving units).

As the transport containers (reusable containers made of plastic as well as disposable containers made of cardboard or wood) are often of different heights (for different products) the shelf thus has an irregular appearance. Furthermore, the flat boxes are mainly very low down on the shelf.

The present objective is to adjust the containers of different heights to "one level" (with regard to the side walls) so that the shelf has a uniform, regular appearance. A further objective is to move the flat containers "closer to the customer" by lifting them slightly.

This is mostly achieved in that nowadays empty plastic containers are placed underneath the filled containers. Mainly in the upper part of the shelf collapsible containers are folded up and placed underneath the containers filled with fruit or vegetables.

This "unintentional use" of transport containers involves high capital investment by the companies that put such transport containers into circulation. The latter may be fruit and vegetable producers (producer's own containers), or may be the warehouse itself (warehouse containers) or may also be a neutral operator of a reusable pool of containers, the containers (rigid or collapsible) of which are not used for their original purpose.

The costs of producing reusable plastic containers are generally very high, particularly if the latter are collapsible containers. If containers with high side walls are not used for their original purpose then costs are even higher because of the large amount of raw material required. Therefore, every operator of a pool of reusable containers aims to keep the number of containers not being used for their original purpose (the so-called trade pipeline) as low as possible.

In addition to the prior art described above WO 2004/110884 A1 and EP 1 921 014 A1 show in practice height-adjustable transport containers, where the side wall height of the transport container is varied in order to change the transport volume.

The objective of the present invention is therefore to replace costly rigid or collapsible plastic containers that are being used as shelf underlay frames and are not being used for their original purpose with inexpensive solutions with the same or even improved functionality.

The present objective of the invention is achieved independently by an underlay device for transportation and presentation containers, wherein the underlay device as the underlay frame of the transportation and presentation container comprises four frame-like side walls or as an underlay apparatus comprises at least three side walls with dimensions such that the transport container can be placed with the bottom part onto the underlay frame or the underlay apparatus, as well as a transportation and presentation container system, in which an underlay device comprising side walls has a profile for stacking on its side facing the bottom part of the transport container, wherein the transport container can be placed onto the upper face side of the side walls of the underlay device. By replacing the transport containers as underlays—as described in the prior art—with underlay devices according to the invention a uniform shelf appearance can be achieved with much less capital investment. It has proved to be advantageous that by means of the stackability of the transport container onto the underlay device excellent display properties are achieved which encourage sales. By means of the rapid and very simple exchange of the empty transport containers in the food, in particular fruit and vegetable, departments, the time required is reduced and thus staffing costs are also reduced.

The underlay device or presentation and transportation container system according to the invention are configured so that they have a stacking edge on the top side, into which any standard, rigid or collapsible container corresponding to ISO standards can be stacked and thereby secured. Such transport containers often have a basic size of 60×40 cm (Typ 64xx) or 40×30 cm (Typ 43xx).

Producing the underlay device by means of an injection molding method, in particular an air-mould or water-mould method or as an extrusion profile, is an inexpensive and simple method of production.

Furthermore, it has proved to be an advantage if the underlay device is made of polypropylene, in particular polypropylene-recyclate, such that the underlay device can be produced inexpensively and in an environmentally friendly way.

It is possible for the underlay device to be formed in one piece, so that assembly of the individual parts after production is unnecessary.

In a further development the side walls of the underlay frame or the underlay apparatus are connected to one another by articulation at least in the corner sections, in particular by a film hinge (other hinge connections are also possible) and are collapsible if necessary, whereby the underlay device can be folded up or collapsed and thus takes up little space when not in use.

Furthermore, it is possible that the side walls, in particular the short side walls, also have an articulation in the middle section and can be folded thereby. Particularly in one variant with high side walls the underlay device according to the invention can also be used for sales islands (secondary placements), as the latter can be stored in a space saving manner when not in use.

The cross section of the underlay device can vary and can be designed to be approximately I, L, C, U, H or cross-shaped, whereby according to the load an underlay device with suitable loading capacity should be used.

In an alternative embodiment the cross section of the underlay device can also comprise a channel and for example can be O, B or A-shaped or the like, in order to make the underlay device more stable.

Furthermore, at least one side wall on its face side facing the bottom part of the transport container can have at least one projection for interacting with the bottom part of the transport container, whereby the transport container can be locked onto the underlay device and thus even when the transport container is loaded unevenly the latter stays in its position on the underlay device.

The side walls of the underlay device can comprise at least in some parts a reinforcing element, wherein the latter is used to achieve greater rigidity of the underlay device and at least part of this reinforcing element can be used as a stacking aid when stacking the underlay frames or the underlay apparatus under the transport container.

In a further development of the invention the reinforcing element can be approximately in the form of a cross, thus improving the stability of the underlay device further.

In one embodiment variant the reinforcing elements can be formed both on the outside and on the inside of the side walls over their entire longitudinal extension or in particular peripherally, whereby a very high degree of rigidity and non-slip stacking of the transport container on the underlay device are possible.

Furthermore, the reinforcing element is arranged in one plane on the inside and also on the outside of the side wall of the underlay device, whereby it is also possible for example for the underlay device to be designed to be very low because high torsional rigidity is achieved by means of the reinforcing element.

In a further development of the invention the reinforcing element of the underlay device can be formed on the inside of the side wall to be step-like in the form of a slightly broader peripheral web, whereby also the internal inner mass of the underlay device can be reduced and thus containers are prevented from falling through, such as for example disposable boxes and wood boxes, which have a smaller periphery than that of the underlay device. This peripheral web can be curved upwards (offset) to ensure the proper support of disposable boxes or wooden boxes.

Furthermore, the at least one reinforcing element can comprise at least one lifting element, in particular at least one pin, whereby the product to be presented on the shelf is moved to the foreground and for example can also project over the top edge of the transport container and thus be more accessible to customers. In order to move the goods on the shelf to the foreground, many retailers in the stores clear out the transport containers (mainly the reusable packaging), place more or less thick, bottom-covering underlays into the transport containers and then the produce is placed on top. In this way the product is arranged further out and projects over the upper edge of the transport container (side wall) and is more accessible to customers. However, the unpacking and packing process damages the goods. The latter should not be handled too much. In addition, this is fairly labor-intensive, particularly if the products are small piece goods.

Furthermore, the at least one lifting element, in particular the at least one pin, can extend both only upwards in relation to the reinforcing element in order to achieve said better presentation of the goods, and can extend both upwards and downwards so that the reinforcing element is not pushed downwards by the weight of the goods to be presented. Thus the weight on the base of the shelf or shelving unit and on the underlay device is supported stably.

The at least one lifting element, in particular the at least one pin, can be configured to be conical and hollow, preferably over its entire height, so that the downwards pointing pins do not collide with the upwards pointing pins, when the empty underlay devices are stacked and nest inside one another.

In an alternative embodiment the at least one lifting element, in particular the at least one pin, can be connected detachably to the at least one reinforcing element, whereby the lifting element or the pin can be removed.

In addition, at least in the corner sections and possibly also in the middle section of the side walls an approximately triangular web can be formed between the outside of the side wall and the upper side of the reinforcing element, whereby also the stability of the underlay device is improved.

The side walls of the underlay device can be formed above the reinforcing element by an extension and below the reinforcing element by an additional extension, whereby the upper extension with its inner wall and the lower extension with its outer wall lie in one plane in the region of the reinforcing elements, whereby also the stacking of several underlay devices on top of one another is made possible, whereby by means of the multiple arrangement of several underlay frames or underlay apparatus on top of one another the desired presentation height necessary for the presentation of the transport container can be selected as desired.

The upper extension can follow a tapering path beginning from the section of the reinforcing element, whereby placing the transport container onto the underlay device is facilitated, because exact positioning is not necessary, but the transport container is positioned automatically in the desired position necessary for stability by means of the tapering path.

In one possible embodiment variant the height of the side walls of the underlay frame can vary, whereby for example an oblique position of the transport container placed on the underlay frame is made possible and thereby the display properties are also improved.

Furthermore, the height of the side walls at least in the corner section of the underlay frame can be greater than in the middle section of the side walls of the underlay frame, whereby only in the corner sections is there an interaction between the underlay frame and transport container and thus for example material can be saved in the production of the underlay frame.

In one embodiment variant one of the side walls of the underlay apparatus can be designed to be rectangular and the two other side walls can be approximately wedge-shaped or trapezoidal, whereby an oblique position of the transport container is made possible and thereby the display properties can also be improved in the showroom without the shelf provided for presenting the food products having to have an oblique standing surface itself.

The side walls of the underlay frame can have different side wall heights, in particular two opposite side walls can have a conical shape and the adjacent side wall at the higher end of one side wall can be higher than at the lower end of one side wall, whereby also the aforementioned oblique position of the transport container and thereby better display properties can be achieved.

In the transportation and presentation container system according to the invention the side walls of the underlay device can have standing surfaces at least in some parts, which essentially correspond in shape to the corresponding areas of the lower side of the bottom part of the transport container, whereby for example by means of the corresponding configuration a stable positioning of the underlay device can be achieved in relation to the transport container.

In addition, it has proved to be advantageous that the underlay device does not project essentially beyond the outer periphery of the side wall parts of the transport container, whereby with the presentation of several transport containers next to one another the latter can be arranged immediately next to one another and thus the food products, in particular fruit and vegetables, can be presented to the purchaser in a space saving manner in the retail store.

The at least, one projection of the underlay apparatus or the upper extension of the underlay frame engage at least in some parts, in particular in the corner section in the bottom part of the transport container, whereby the sliding of the transport container on the underlay device is prevented, even when the latter is arranged obliquely.

Furthermore, the at least one projection of the underlay apparatus beyond the full longitudinal extension of the side walls can interact with the bottom part of the transport container or the upper extension of the underlay frame can engage peripherally with the bottom part of the transport container, whereby even with an unevenly loaded transport container or with an unintentional impact on the transport container any sliding or displacement of the latter is prevented and thus the rearrangement of transport containers in the showroom of the retailer is unnecessary.

The reinforcing element can comprise at least one lifting element, in particular a pin, which engages in at least one recess of the bottom part of the transport container and interacts with a movable inlay element in the region of the bottom part of the transport container, whereby the presentation of the product can be highlighted more effectively without the latter having to be repacked after storage or transport, which may damage the product and is labor-intensive, especially for small piece goods.

The transportation and presentation container system according to the invention is used preferably for the presentation of food products, in particular fruit and vegetables, so that optimal presentation is achieved with regularity in the height of the containers and a uniform appearance of the shelf.

The underlay device and the transportation and presentation container system according to the invention is represented partly in a much simplified and schematic form in the following figures.

FIG. 9 shows a side view of part of the underlay frame according to the invention with a reinforcing element and lifting element designed to be step-like;

Figure 1:
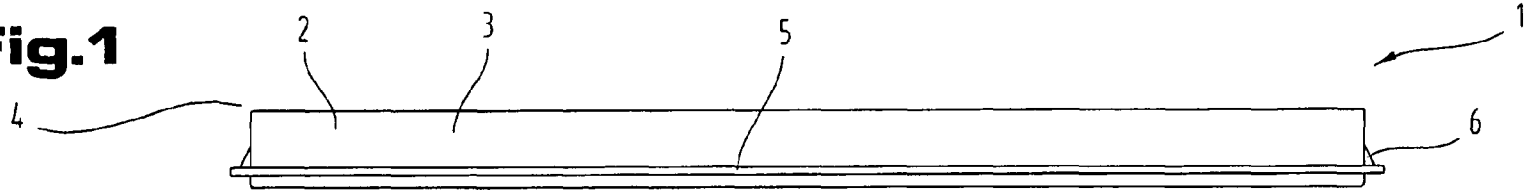
FIG. 1 shows a side view of the underlay frame according to the invention.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position. Furthermore, also individual features or combinations of features from the various exemplary embodiments shown and described can represent in themselves independent or inventive solutions.

All of the details relating to value ranges in the present description are defined such that the latter include any and all part ranges, e.g. a range of 1 to 10 means that all part ranges, starting from the lower limit of 1 to the upper limit 10 are included, i.e. the whole part range beginning with a lower limit of 1 or above and ending at an upper limit of 10 or less, e.g. 1 to 1.7, or 3.2 to 8.1 or 5.5 to 10.

The present invention describes an underlay device in different embodiments, such as for example in the form of an underlay frame or underlays apparatus, onto which a transportation and presentation container can be placed as well as a transportation and presentation container system.

FIG. 1 shows a possible embodiment of the underlay device 1, wherein the latter is designed as an underlay frame 2. The underlay frame 2 comprises four side walls 3, 3', 3", 3'", which are designed in the form of a frame. In FIG. 1 the underlay frame 2 is designed in one piece. In an alternative embodiment it is also possible for the underlay frame 2 to be designed in multiple parts, in that for example the individual side walls 3, 3', 3", 3'" are connected by articulations, in particular hinges. The hinges are preferably arranged in the corner sections 4 of the underlay frame 2. The articulated configuration of the underlay frame 2 can also be achieved for example by means of a material weakening in the corner sections 4, whereby for example the underlay frame 2 can be produced as a extrusion profile as well as by an injection molding method.

In a further development of the underlay frame 2 it is also possible for additional articulations to be provided, which for example are also arranged in the region of the longitudinal extension of the side walls 3, 3', 3", 3'", whereby in addition to the collapsibility of the underlay frame 2 the side walls 3, 3', 3", 3'" of the underlay frame 2 can also be folded and in this way the underlay frame 2 can be stored in a space-saving manner, in that for example collapsed and folded underlay devices 1 can be stored in stacks of underlay devices 1 stacked on top of one another. In a further development also a locking device can be provided for locking the articulations, in order to prevent the unintentional collapse of the underlay device 1. This may be an advantage for underlay devices 1 with high side walls 3, 3', 3", 3''' for use in sales islands, such as e.g. secondary placements, in order in the case of unintentional impact, such as e.g. from a shopping trolley or lifting truck, to prevent the collapse of the side walls 3, 3', 3", 3'''.

Furthermore, in the region of the side walls 3, 3', 3", 3''' at least one reinforcing element 5 is arranged. Said reinforcing element 5 can be arranged both on the outside of the side walls 3, 3', 3", 3''' and also on the inside of the side walls 3, 3', 3", 3''' of the underlay frame. The reinforcing element 5 can also only be arranged on the outside or the inside of the side walls 3, 3', 3", 3''', wherein the dimensions of the reinforcing elements 5 on the inside and outside of the side walls 3, 3', 3", 3''' can be different and for example the reinforcing elements 5 can project further inwards than outwards and thus provide greater torsional rigidity and also variability in the standing surface for transport containers 12. The reinforcing element 5 on the inner side of the side walls 3, 3', 3", 3''' can also be designed to be curved upwards. The reinforcing elements 5 can be arranged only in some parts or peripherally as shown in FIG. 1. In a preferred embodiment variant the reinforcing elements 5 are arranged on one plane both on the inside and also on the outside of the side walls 3 of the underlay frame 2. Furthermore, the reinforcing elements 5 can also be configured to be almost cross-like and can extend between the side walls 3, 3', 3", 3''' and thus improve the stability of the underlay device 1 further.

In order to achieve greater stability of the underlay frame 2, at least in the corner sections 4 and possibly also along the longitudinal extension of the side walls 3, 3', 3", 3''' approximately triangular webs 6 can be formed between the outside of the side wall 3, 3', 3", 3''' and the upper side of the reinforcing element 5. The webs 6 can also be arranged on the inside of the side wall 3, 3', 3", 3'''.

Figure 2:
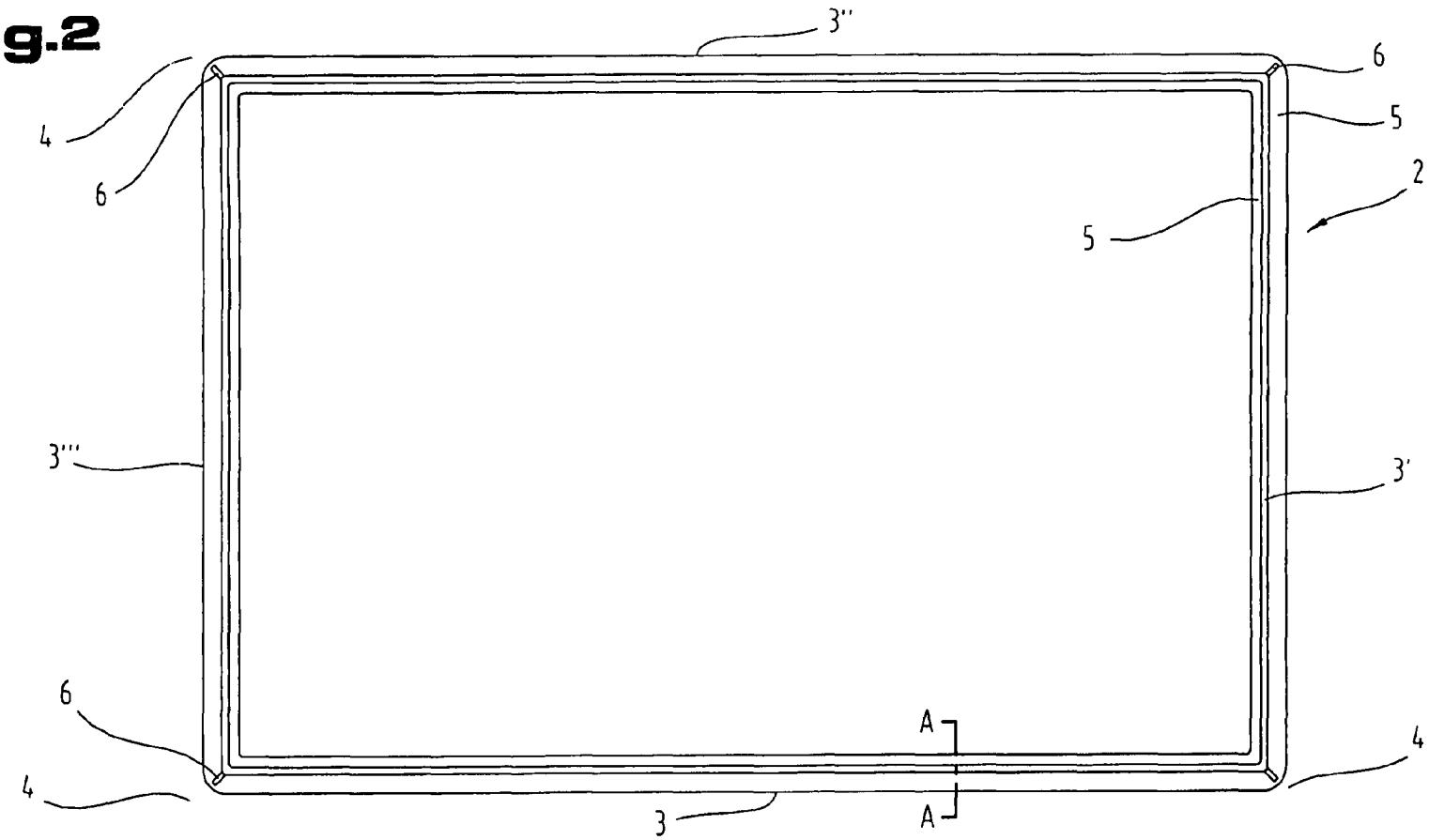
FIG. 2 shows a plan view of the underlay frame according to the invention.

FIG. 2 shows a first embodiment of an underlay frame 2 according to the invention in plan view, wherein in the shown figure the triangular webs 6 are only provided in the corner sections 4 and the reinforcing element 5 is designed to be peripheral.

Figure 3:
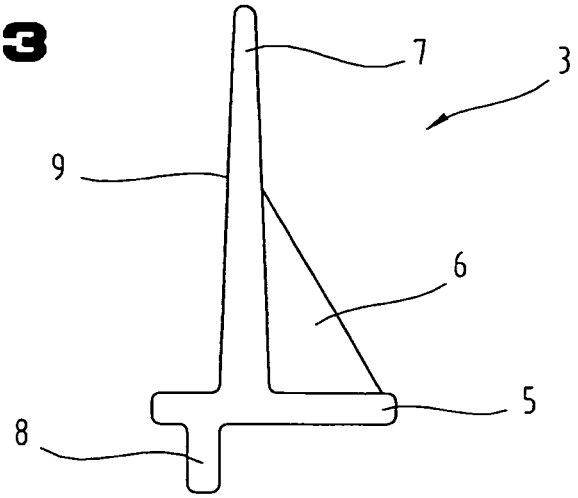
FIG. 3 shows a cross section A-A of a possible embodiment variant of the underlay frame according to the invention.

FIG. 3 shows a cross section of a longitudinal side wall 3 of the underlay frame 2. The side wall 3 shows an extension 7 above the reinforcing element 5 and a further extension 8 below the reinforcing element 5, wherein the upper extension 7 with its inner wall 9 and the lower extension 8 with its outer wall 10 lie in the region of the reinforcing elements 5 in one plane. In addition, the upper extension 7 follows a tapering path beginning from the area of the reinforcing element 5.

Figure 4:
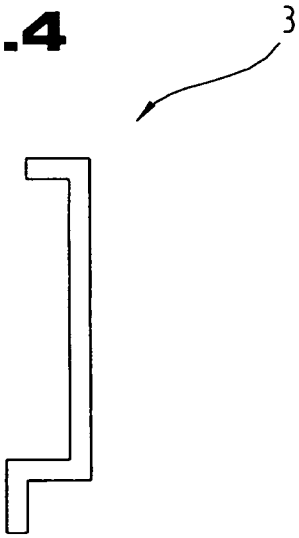
FIG. 4 shows a cross section A-A of a further possible embodiment variant of the underlay frame according to the invention.

In addition to the almost cross-like cross section of the underlay frame 2 shown in FIG. 3 the underlay device 1 according to the invention can also have any other cross-sectional form, such as for example an approximately C-shaped cross section, as shown in FIG. 4. In this case the side wall 3 of the underlay frame 2 can have the profile shown in FIG. 4. In an alternative embodiment the profile shown in FIG. 4 can also simply form the upper extension 7 of the side wall 3 of the underlay frame 2.

Figure 5:
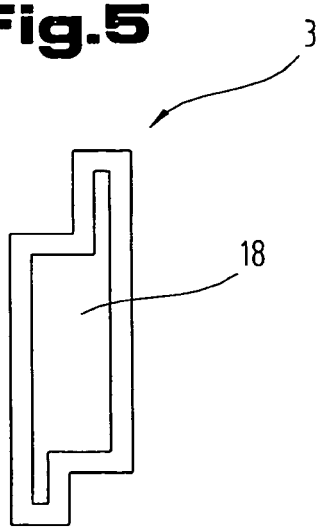
FIG. 5 shows a cross section A-A of a further possible alternative embodiment variant of the underlay frame according to the invention.

FIG. 5 shows a further possible embodiment of the cross section of the underlay frame 2. As already described in FIG. 4, the cross sectional form shown in FIG. 5 can apply to the whole side wall 3. of the underlay frame 2 or simply the upper extension 7 of the underlay frame 2 can be configured according to FIG. 5. The side wall 3 here comprises a channel 18, wherein one side wall 3, 3', 3", 3''' is produced with a channel 18 preferably by means of an air-moulding method.

Figure 6:
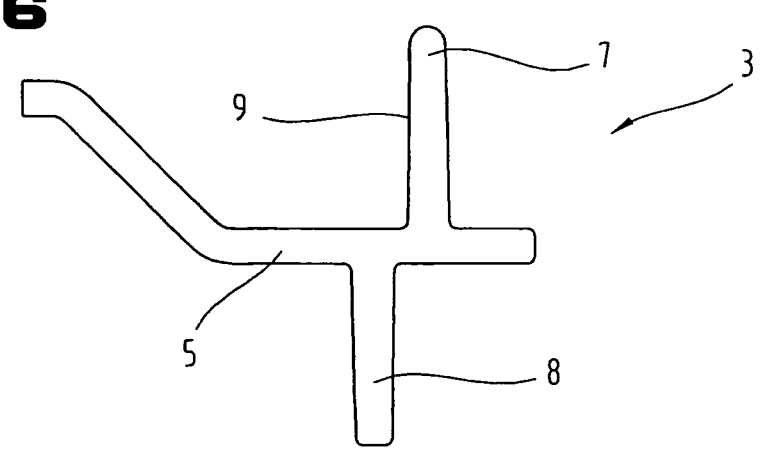
FIG. 6 shows a cross section A-A of a development of the underlay frame according to the invention.

FIG. 6 shows a cross section A-A of a development of the underlay frame 2 according to the invention, wherein the reinforcing element 5 is designed to be step-like. The step can have an angle of approximately 90° or, as shown in FIG. 6, can be configured to be sloping. In addition several steps can also be provided. In this way containers of different sizes can be placed on the underlay frame 2 according to the invention, in particular on the inner reinforcing element 5, and thereby an optimal support can be provided for cardboard or wooden containers possibly placed on the shelf. The step is not so far up however that it could be disruptive for reusable plastic containers. If the reinforcing element 5 is designed to be peripheral recesses can be provided, through which for example dirt can fall that collects in the region of the step. If articulations are arranged on the underlay device 1, the reinforcing element 5 in this area is also interrupted.

Of course, other not shown embodiments and cross-sectional shapes of the side walls 3, 3', 3", 3''' of the underlay frame 2 are possible, by means of which the bottom part 13 of a transport container 12 can be placed onto the underlay frame 2.

The underlay device 1 according to the invention can be produced according to an air-molding or water-molding method and also as an extrusion profile.

Figure 7:
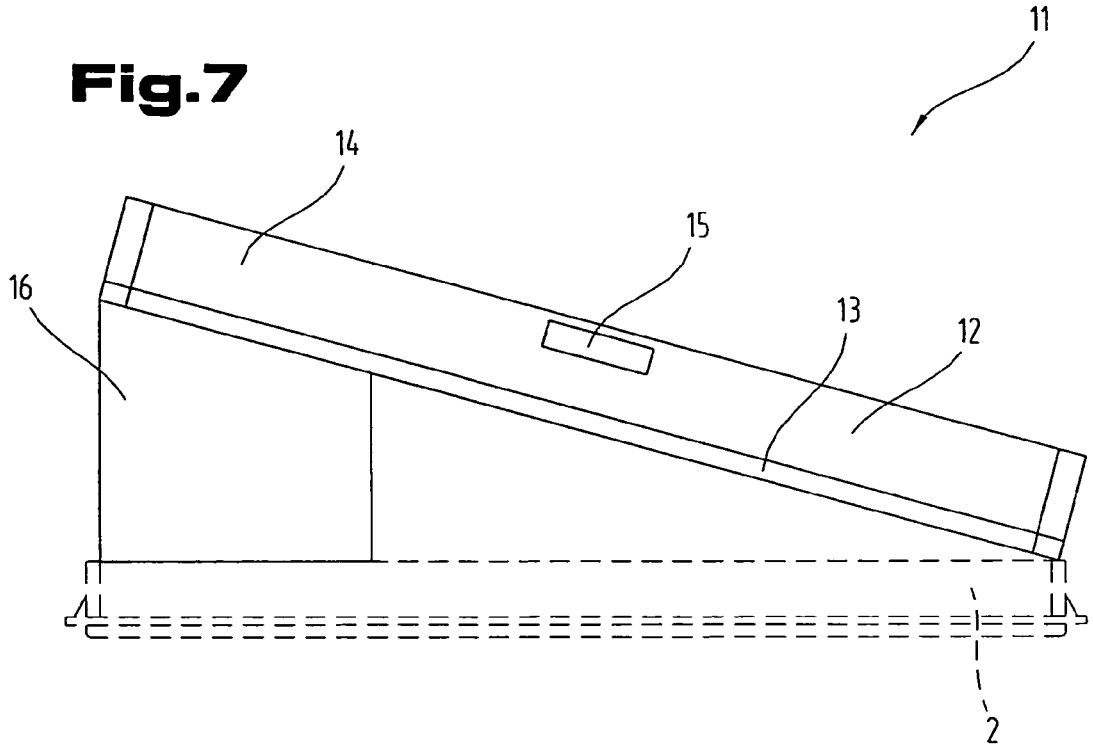
FIG. 7 shows a side view of the transportation and presentation container system according to the invention.

FIG. 7 shows a transportation and presentation container system 11 comprising a transport container 12, in particular a collapsible transport container 12, with a bottom part 13 and four side wall parts 14, 14', 14", 14''', wherein a gripping recess 15 can be arranged along at least one of the side wall parts 14, 14", and the previously described underlay frame 2 and an underlay apparatus 16 arranged in between comprising three side walls 17, 17', 17", wherein the underlay device 1, i.e. the underlay frame 2 and the underlay apparatus 16 have a profile for stacking on their side facing the bottom part 13 of the transport container 12 so that the transport container 12 can be placed on the upper face side of the side walls 17, 17', 17"—as shown in FIG. 7—or as not shown on the upper face side of the side walls 3, 3', 3", 3''' of the underlay device 1. The underlay frame 2 shown in FIG. 7 by dashed lines is only optional and the transportation and presentation container system 11 can also simply comprise a transport container 12 and an underlay apparatus 16 or a transport container 12 and an underlay frame 2.

Figure 8:
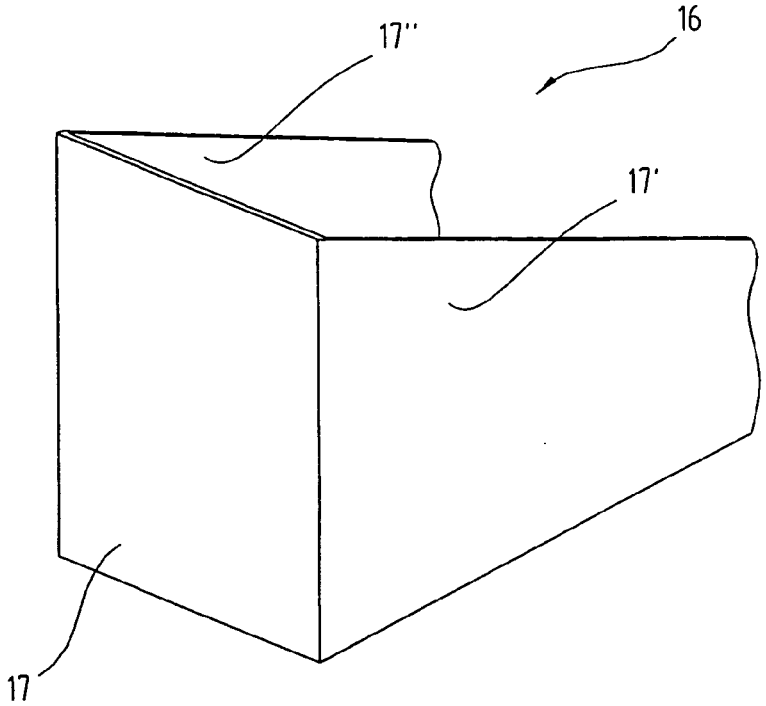
FIG. 8 shows a perspective view of the underlay apparatus according to the invention.

FIG. 8 shows that the underlay apparatus 16 comprising at least three side walls 17, 17', 17" has an almost rectangular or quadratic side wall 17 and the two adjacent side walls 17', 17" are configured to be almost trapezoidal or almost wedge-shaped. In an alternative not represented embodiment the underlay apparatus 16 can also comprise an additional side wall 17''', wherein the two opposite side walls 17, 17" are designed to be wedge-shaped or trapezoidal and the side walls 17', 17''' are approximately rectangular or quadratic and thus are positioned underneath the transport container 12 so that the entire bottom part 13 does not necessarily interact with the underlay apparatus 16, but contact only takes place as long as the transport container 12 is supported by the underlay apparatus 16.

The underlay apparatus 16 can be designed to be in one piece and also in multiple parts and for example the side walls 17, 17', 17" of the underlay apparatus 16 can be articulated, in particular joined together by a film hinge and thereby collapsible. To connect a plurality of several collapsed underlay devices 1 a connecting device can also be provided which prevents the sliding of the underlay devices 1.

The side walls 17, 17' 17" of the underlay apparatus 16 can comprise at their face end side facing the bottom part 13 of the transport container 12 at least one not shown projection for interaction with the bottom part 13 of the transport container 12. The projection can be provided only in some parts or also over the entire longitudinal extension of the side walls 17, 17", 17'''.

The profile of the side walls 17, 17', 17" and possibly 17''' of the underlay apparatus 16 can also have any cross-sectional shape as with the underlay frame 2 and does not necessarily have an I-shaped cross section, as shown in FIG. 8.

The side walls 3, 3', 3", 3''', 17, 17', 17", 17''' of the underlay frame 2 or the underlay apparatus 16 should have at least in some parts standing surfaces which correspond essentially with the corresponding areas of the lower side of the bottom part 13 of the transport container 12, whereby the positioning of the transport container 12 on the underlay device 1 is made possible.

Furthermore, FIG. 7 shows that it is an advantage that the underlay device 1 projects only slightly beyond the outer periphery of the side wall parts 14, 14', 14" 14''' of the transport container 12.

It is possible that the at least one projection of the underlay apparatus 16 or the upper extension of the underlay frame 2 or respective standing surface of the underlay device 1 interacts or engages at least in some parts with the bottom part 13 of the transport container 12.

For example, the interaction of the projections with the bottom part 13, in particular in the corner sections 4 of the transport container 12 has proved advantageous.

In order to obtain particularly high stability of the transportation and presentation container system 11, the at least one projection of the underlay apparatus 16 can interact over the entire longitudinal extension of the side walls 3 with the bottom part 13 of the transport container 12 or the upper extension 7 of the underlay frame 2 can engage peripherally with the bottom part 13 of the transport container 12 or any standing surface of an underlay device 1 can interact over its full longitudinal extension with the bottom part 13 of the transport container 12.

In a further development of the invention of the transportation and presentation container system 11 the underlay device 1 can be connected to the transport container 12 by securing means, as known from the prior art, in particular can be connected detachably.

The height of the side walls 3, 3', 3", 3''', 17, 17', 17", 17''' of the underlay device 1 can vary and for example can be greater only in the corner sections 4 of the underlay frame of the underlay device 1 than in the middle section of the side walls 3, 3', 3", 3''', 17, 17', 17", 17''', whereby interaction with the bottom part 13 of the transport container 12 only occurs in the corner sections 4. Thus the height can vary within a side wall 3, 3', 3", 3''', 17, 17', 17", 17'''.

In an alternative embodiment the side walls 3, 3', 3", 3''' of the underlay frame 2 can have different side wall heights, whereby in particular two opposite side walls 3', 3''' can have an almost conical shape and the side wall 3 adjacent to the one side wall 3' at the higher end has a greater height than the one at the lower end of the side wall 3" adjacent to the one side wall 3'.

Recesses can also be provided in the path of the side walls 3, 3', 3", 3''', 17, 17', 17", 17''', which makes it possible to save material. Thus for example in the case of a wedge-shaped or trapezoidal underlay device 1 either only the standing surface can be formed on the shelf or base or only the standing surface to the bottom part 13 of the transport container 12 can be designed to be fully peripheral.

The underlay device 1 as such can also be configured to be conical, so that as a rule an angle of inclination is formed between the shelf base (shelving unit) and transport container 12.

Figure 9:
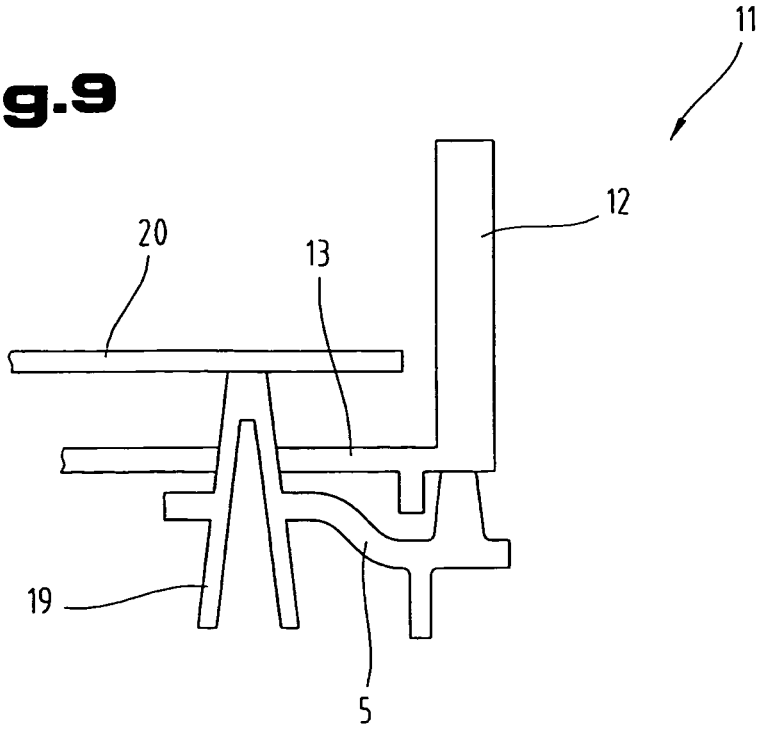

FIG. 9 shows a further development of the underlay frame 2, in which at least one lifting element 19, in particular pin, is arranged in the region of the reinforcing element 5. The pin can extend upwards and also downwards. The pin 19 is preferably designed to be conical and hollow, whereby a plurality of underlay frames 2 can be nested inside one another and thus can be stored in a space-saving manner. The pin 19 engages in recesses 21 in the bottom part 13 of the transport container 12 and interacts with an inlay element 20 in the transport container 12. The lower end of the extension 8 and the lower end of the pin 19 preferably lie in one plane in order to be supported on a shelving unit or floor on the same standing plane.

The lifting element 19 can have any shape, and for example can also be approximately round, rectangular, quadratic, triangular etc. in cross section. If the lifting element 19 is configured for example to be approximately rectangular, it can engage in an approximately rectangular recess 21 of the transport container and thereby lift up an inlay element 20 arranged therein. The lifting element 19 can in this way be configured only as an edge, partly flat or fully flat.

In one possible embodiment variant, e.g. at the inner corners of the reinforcing element 5, a pin can be arranged respectively, which points upwards (for example with diameter of 1 cm). If a transport container 12, in particular reusable container or cardboard, has at this point an almost round recess 21 said four pins engage with the inside of the transport container 12. In the transport container 12 on the bottom part 13 is an inlay element 20 made of plastic, cardboard or the like, wherein the inlay element 20 covers almost the entire inner area of the transport container 12 in the area of the bottom part 13 and in addition is sufficiently strong or thick to support the weight of the product to be presented which is in the transport container 12. The inlay element 20 is placed prior to the filling of the transport container 12 with food products, such as fruit, vegetables, etc. onto the bottom part 13 of the transport container 12, on which the products is laid. If the transport container 12 is now placed in the shelf on the underlay device 1 according to the invention the pins engage in the recesses 21 of the transport container 12 and push the inlay element 20 with the product upwards. In this way the whole product is moved upwards without the product, such as fruit or vegetables, having to be unpacked. The inlay element 20 can be inserted for example by the pool operator or fruit and vegetable packer as soon as the transport containers 12 are set up and filled. The inlay element 20 can be provided with advertising on the upper side so that—when the consumer looks into the transport container 12 from above—the advertising can be recognized, whereby this is mainly effective when some of the product has already been taken out of the transport container 12. The inlay element 20 can have different design or decoration elements on the upper side to improve the aesthetic appearance.

If it is necessary—e.g. for stability reasons, (if e.g. the inlay element 20 can be made to be not too thick), for more than four pins to be attached to the reinforcing element 5, then this is also possible. If also one or more pins should be necessary for support in the middle section of the underlay device 1, a cross can be built into the underlay frame 2 or the reinforcing element 5 can be configured to be approximately cross-like to which additional pins are attached. In an alternative embodiment the cross itself can also be configured as a lifting element 19 and engage in the recess 21 of the transport container 12 and thus lift up the product placed therein on an inlay element 20.

In order that the peripheral reinforcing element 5 or cross (with central bearing pin) is not pressed downwards by the weight of the product, the pin find an extension downwards, i.e. below the peripheral reinforcing elements 5 or cross. By means of this pin downwards the entire weight is then on the base of the shelf (shelving unit) and is supported stably thereby.

If the empty underlay devices 1 now have to be stacked (e.g. for empty transport or for storage, if the shelf underlay devices 1 are not required), the downwards lifting elements 19, in particular pins, must not collide with the upwards lifting elements 19, in particular pins. For this reason the lifting elements 19, in particular pins, are designed to be conical and hollow over their full height. In this way they can nest inside one another if the empty frames are stacked.

If the lifting elements 19, in particular pins, are not arranged permanently they can be clipped in an alternative version of the underlay device into the peripheral reinforcing element 5 or into the cross (as a separate part) or screwed (e.g. screwed in and out by a short screw thread) and thus designed to be detachable.

In an alternative embodiment variant the lifting elements19, in particular pins, can also be connected by articulation to the reinforcing element 5, whereby they can be changed when not in use.

Figure 10:
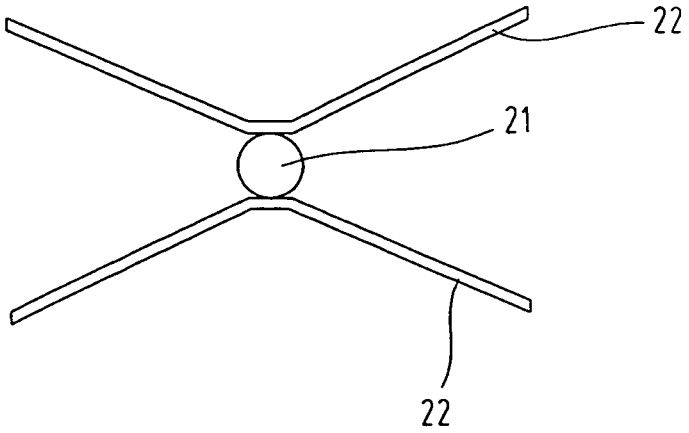
FIG. 10 shows a plan view of a section of the lower side of a bottom part of the transportation and presentation container system according to the invention.

In a further development it is possible in the region of the recesses 21 on the lower side of the bottom part 13 of the transport container 12, which interact with the lifting elements 19 of the underlay device 1, to arrange at least one guiding element 22 in order to facilitate the joining of the lifting elements 19 of the underlay device 1 into the recesses 21 of the transport container 12. FIG. 10 shows a possible embodiment variant of a section of the lower side of the bottom part 13 of the transport container 12 with recesses 21 and guiding elements 22. The guiding elements 22 can be configured as insertion webs, for example approximately wedge-shaped. Said insertion webs can be arranged for example such that if the transport container 12 is placed slightly above or below the recesses 21 on the lifting elements 19 of the underlay device, by simply sliding backwards and forwards the transport container 12 on the lifting element 19 the guiding elements 22 form a guide which automatically moves the transport containers 12 in the direction that the lifting elements 19 are guided into the recesses 21 and then engage. In this way it is possible to avoid a time-consuming search process when fitting the transport container 12 onto the underlay device 1, in order to engage in the lifting elements 19.

Said guiding elements 22 can be arranged for each or only for one or several selected lifting elements 19.

Figure 11:
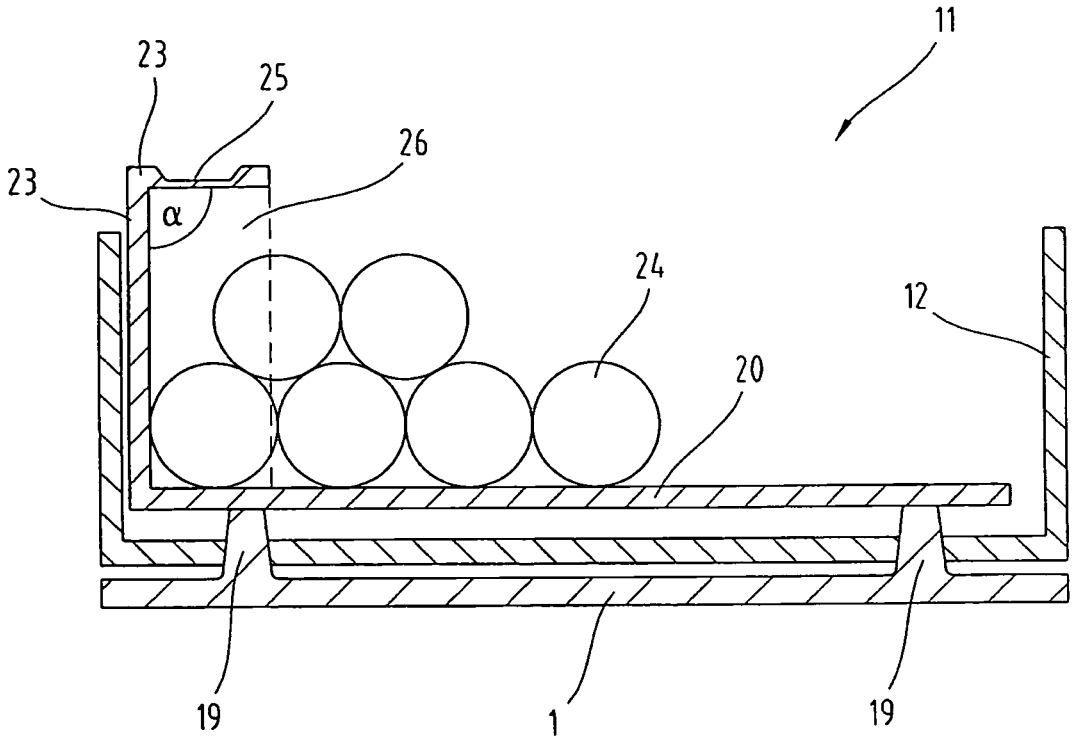
FIG. 11 shows a side view of the transportation and presentation container system according to the invention with inlay element.

FIG. 11 shows in a much simplified representation the underlay device 1 according to the invention and the transport container 12 as well as the inlay element 20. In the shown embodiment variant the inlay element 20 has a first 90° angle 23 and at its upper end again a 90° angle 23. The first angle 23 prevents products from rolling out, such as e.g. a piece of fruit 25, when the transportation and presentation container 12 is placed on a sloping shelf or the underlay device 1 is configured to be sloping. The second angle 23 also prevents the product from rolling down or sliding. In addition on the second angle 23 a display 25 can be provided. Product information can be adhered to the display 25 or can be applied by means of an insert pocket.

In an alternative embodiment of the invention only a first angle 23 is provided.

In a further development of the inlay element 20 at least one wall 26 can be arranged, as shown in FIG. 11. The wall 26 increases the torsional stability of the inlay element 20, in particular the angles 23. Alternatively to the wall also only one web can be formed which is not over the whole surface like the wall 26.

Preferably, the first angle 23 is at an angle of about 90° relative to the base of the inlay element 20. FIG. 11 shows that the second angle 23 is also about 90°. Said second angle 23 can however also be an angle $\alpha$ different from 90°, in particular an obtuse angle in relation to the first angle 23.

To achieve the desired presentation height and thus level the transport containers 12, it is also possible to stack several underlay devices 1 above one another cumulatively, whereby the underlay device 1 with the lower or upper stack edge is shaped so that it can also be stacked and thus if necessary can function as a modular system.

The wall thickness of the underlay device 1 is preferably selected such that it can be stacked by means of the transport container 12 filled with the product to be transported.

On one underlay device 1 also several transport containers 12 can be arranged next to one another. Thus for example on an underlay device 1 with dimensions 600×400 two transport containers 12 with dimensions 300×400 can be stacked or positioned. The lifting elements 19 are thereby arranged so that they engage both in the recesses 21 of a 600×400 transport container 12 and also in the recesses 21 of two 300×400 transport containers 12. The recesses 21 in the bottom part 13 of the transport container 12 are thus always arranged in accordance with the requirements.

In an alternative production method the underlay device 1 according to the invention can also be made in one piece and be created by connecting the free ends of the wall-shaped side walls 3, 3''' or 17, 17'' (17''') and thus be configured as an extrusion profile.

The transport container 12 can be designed to be collapsible or non-collapsible. The transport container 12 comprises in addition to the rectangular bottom part 13 two essentially parallel side wall parts 14 and 14' and two essentially parallel side wall parts 14'' and 14'''. The side wall parts 14, 14', 14'', 14''' are collapsible towards the inner surface of the bottom part 13 of the transport container 12.

The above explanations made in connection to the underlay frame 2 relating to the reinforcing element 5, the web 6, the articulations and the different cross sections also apply of course to the underlay apparatus 16, and in turn the explanations made above in connection with the underlay apparatus 16 relating to the projection also apply to the underlay frame 2.

In a further development at least one of the side walls 3, 3', 3'', 3''', 17, 17', 17'', 17''' of the underlay device 1 can have a recess in its area adjacent to the standing surface, whereby it is possible that the person when filling the transport containers 12, which are placed on the underlay device 1 according to the invention, mainly when the latter are arranged in the form of sales islands, can put their feet under the underlay device 1 and can thus change or refill the transport containers 12 more easily.

The underlay device 1 according to the invention is preferably made of plastic, in particular polypropylene, preferably polypropylene-recyclate, whereby it is also possible to use another known plastic or alternative material, such as cardboard or wood—as known from the prior art for the production of transport containers.

The dimensions of the underlay device 1 can vary so that any standard rigid or collapsible container corresponding to ISO standards can be stacked and fixed thereby.

The exemplary embodiments show possible embodiment variants of the underlay device 1, whereby it should be noted at this point that the invention is not restricted to the embodiment variants shown in particular, but rather various different combinations of the individual embodiment variants are also possible and this variability, due to the teaching on technical procedure, lies within the ability of a person skilled in the art in this technical field. Thus all conceivable embodiment variants, which are made possible by combining individual details of the embodiment variants shown and described, are also covered by the scope of protection.

FIGS. 7 and 8 show a further and if necessary independent embodiment of the underlay device 1 of the transportation and presentation container system 11, wherein for the same parts the same reference numerals or components names have been used as in the preceding FIGS. 1 to 6. To avoid unnecessary repetition reference is made to the detailed description of the preceding figures.

Finally, as a point of formality, it should be noted that for a better understanding of the structure of the underlay device 1 or the transportation and presentation container system 11 the latter and its components have not been represented true to scale in part and/or have been enlarged and/or reduced in size.

The problem addressed by the independent solutions according to the invention can be taken from the description.

Mainly the individual embodiments shown in FIGS. 3, 4, 5, 6; 7, 8 can form the subject matter of independent solutions according to the invention. The objectives and solutions according to the invention relating thereto can be taken from the detailed descriptions of these figures.

LIST OF REFERENCE NUMERALS

1 Underlay Device
2 Underlay Frame
3 3', 3", 3"' Side Wall
4 Corner Section
5 Reinforcing Element
6 Web
7 Extension
8 Extension
9 Wall
10 Wall
11 Transportation and Presentation Container System
12 Transport Container
13 Bottom Part
14 14', 14", 14"' Side Wall Part
15 Gripping Recess
16 Underlay Apparatus
17 17', 17", 17"' Side Wall
18 Channel
19 Lifting Element
20 Inlay Element
21 Recess
22 Guiding Element
23 Angle
24 Fruit
25 Display
26 Wall

The invention claimed is:

1. A transportation and presentation container system comprising a transportation and presentation container with a bottom part and four side wall parts and an underlay device for the transportation and presentation container for food, wherein the underlay device comprises an underlay frame of the transportation and presentation container with four side walls arranged in a frame and/or an underlay apparatus with three side walls, wherein the transportation and presentation container can be placed with the bottom part onto the underlay frame or the underlay apparatus, wherein on its area facing the bottom part of the transportation and presentation container the underlay device supports the transportation and presentation container, wherein the side walls of the underlay frame or the underlay apparatus comprise at least one reinforcing element, which comprises at least one lifting element, which engages in and extends through at least one opening in the bottom part of the transportation and presentation container and interacts with a movable inlay element in the region of the bottom part of the transportation and presentation container.

2. The transportation and presentation container system as claimed in claim 1, wherein the side walls of the underlay frame or the side walls of the underlay apparatus comprise an articulation at least in the corner sections and/or in the middle section, and are thus collapsible.

3. The transportation and presentation container System as claimed in claim 1, wherein channel is formed in the cross section Of the side walls of the underlay frame or the underlay apparatus.

4. The transportation and presentation container system as claimed in claim 1, wherein at least one side wall of the underlay apparatus or at least one side wall of the underlay frame on its face side facing the bottom part of the transportation and presentation container comprises at least one projection for interacting with the bottom part of the transport container.

5. The transportation and presentation container system as claimed in claim 1, wherein the side walls of the underlay frame or the underlay apparatus comprise at least one reinforcing element extending approximately in the form of a cross between the side walls.

6. The transportation and presentation container system as claimed in claim 1, wherein the reinforcing element on the inside of the side wall is configured to be step-like.

7. The transportation and presentation container system as claimed in claim 1, wherein the at least one lifting element comprises a pin extending downwards and/or upwards in relation to the reinforcing element.

8. The transportation and presentation container system as claimed in claim 1, wherein the least one lifting element comprises a conical pin.

9. The transportation and presentation container system as claimed in claim 1, wherein the at least one lifting element is designed to be hollow.

10. The transportation and presentation container system as claimed in claim 1, wherein the side walls of the underlay frame have different side wall heights, wherein two opposite side walls follow a conical path. and the adjacent side wall at the higher end of the one side wall has a greater height than at the lower end of the side wall adjacent to the one side wall.

11. The transportation and presentation container system as claimed in claim 1, Wherein the support between the transportation and presentation container and the underlay device is provided an extension and/or reinforcing element.

12. The transportation and presentation container system as claimed in claim 1, wherein the underlay device does not project over the outer periphery of the side wall parts of the transportation and presentation container.

13. The transportation. and presentation container system as claimed in claim 1, wherein the inlay element comprises at least one angle.

14. The transportation and presentation container system as claimed in claim 1, wherein in the region of the at least one opening at least one guiding element is arranged for the lifting element of the underlay device.

* * * * *